United States Patent [19]

Widolf

[11] 4,103,917

[45] Aug. 1, 1978

[54] SKATEBOARD TRUCK

[75] Inventor: Philip R. Widolf, Santa Ana, Calif.

[73] Assignee: Woody-Widolf, Inc., Newport Beach, Calif.

[21] Appl. No.: 735,651

[22] Filed: Oct. 26, 1976

[51] Int. Cl.[2] ..... A63C 17/02

[52] U.S. Cl. ..... 280/11.28; 151/49; 280/87.04 A

[58] Field of Search ..... 280/11.28, 87.04 A; 151/49

[56] References Cited

U.S. PATENT DOCUMENTS

| | | | |
|---|---|---|---|
| 2,595,751 | 5/1952 | Balstad | 280/11.28 |
| 2,664,295 | 12/1953 | Van Horn | 280/11.28 |
| 2,719,725 | 10/1955 | Ware | 280/11.28 |
| 3,442,523 | 5/1969 | Butler | 280/11.28 |
| 3,862,763 | 1/1975 | Ware | 280/11.28 |

FOREIGN PATENT DOCUMENTS

| | | | |
|---|---|---|---|
| 930,978 | 7/1955 | Fed. Rep. of Germany | 280/11.28 |

*Primary Examiner*—David M. Mitchell
*Attorney, Agent, or Firm*—Knobbe, Martens, Olson, Hubbard & Bear

[57] ABSTRACT

A wheel housing is resiliently mounted on a skateboard truck base by means of a fastener which extends through the housing and is threaded onto a stud fixed to the base to compress a tubular cushion between the housing and the base. The fastener has a square cross-section which mates with a square bore in the cushion so that rotation of the fastener with respect to the cushion is prevented except when the retainer is manually forceably rotated to adjust the compression on the cushion.

15 Claims, 5 Drawing Figures

SKATEBOARD TRUCK

This invention relates to an improved truck for a skateboard or similar item and more particularly relates to an improved mounting means for providing a fully adjustable, cushioned action with tension adjustment and no chance of getting out of adjustment.

There are a large number of different skateboard and roller skate truck constructions, most of which involve a spring or a resilient cushion connected between the wheel housing and the base or other support structure. The parts are typically connected by nut and bolt arrangements.

It is desirable that the connections be adjustable so that the cushioning effect of the wheel housing with respect to the skateboard platform can be easily varied as desired. It is further desirable that the selected adjusted position be easily locked so that the cushioning will not become out of adjustment. A variety of arrangements have been suggested for such adjustment and locking; however, in most cases, the systems are not reliable, are difficult to adjust or are too complex. Thus, a need still exists for an inexpensive highly reliable easily adjustable wheel mounting truck.

In accordance with the present invention, there is provided a base which is attached to the skateboard platform or other device on which the truck is to be used. A wheel housing is connected to the base by means of a threaded fastener means which extends through a hole in the housing and is connected to the base. A tubular cushion surrounding the fastener is compressed between the housing and the base so that the housing is resiliently mounted on the base. The cushion and the fastener means cooperate to lock the fastener means in a selected position. Nevertheless, the resiliency of the cushion permits the fastener means to be manually adjusted to vary the compression on the cushion.

In a preferred arrangement, the fastener means includes a fastener having a shank with a square cross-section which extends into an interior bore of the cushion having a mating cross-section. The base has an integrally formed post which extends upwardly into one end of the cushion, and a threaded stud secured to the post is received within a threaded bore in the fastner shank. Additionally, both the base and the wheel housing are provided with rectangular recesses which receive rectangular ends of the cushion to prevent rotation of the cushion. A washer with a square hole is also mounted on the fastener and is compressed between the housing and an enlarged head on the fastener.

With this arrangement, the compression can be easily adjusted but yet the resistance of the cushion prevents the fastener from rotating during operation of the skateboard. Operation of the board introduces considerable compressive forces on the cushion; however, the forces attempting to rotate the fastener with respect to the cushion are not very large so that the fastener is easily prevented from rotation by the cushion. In addition to being easily adjustable and reliably locked, it should be noted that the design is quite simple, employing only the cushion and the washer and four metal parts, namely the base, housing, stud, and fastener.

Further features and advantages of the invention will become apparent by reference to the following drawing and detail description in which.

Figure 1:
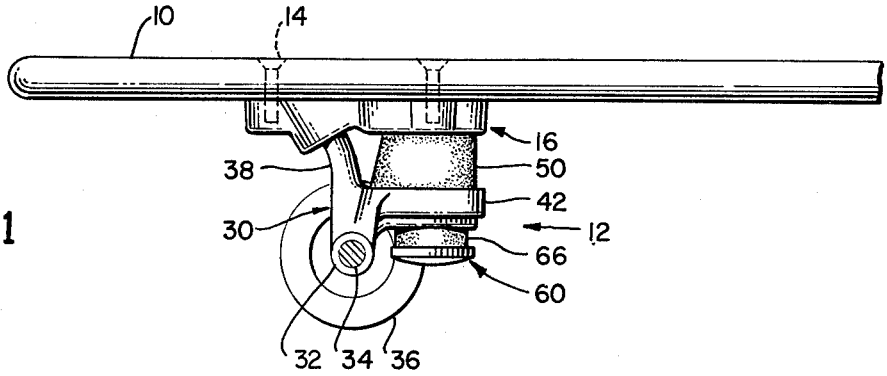
FIG. 1 is a side elevational view of the truck of the invention mounted on a skateboard platform.

Referring first to FIG. 1, there is shown a skateboard platform 10 having a truck 12 mounted thereon by threaded fasteners 14 which extend through the platform and into a support member or base 16. As can be seen, the base 16 has a flat upper surface which engages the lower surface of the platform 10. A few recesses 18 are formed in that upper surface simply for material savings during casting. On its lower surface, the base is formed with a rectangular recess 20 and a downwardly extending post 22, somewhat centrally positioned in the recess 20. A threaded stud 23 is mounted in a bore in the post by being threaded into the bore or by other suitable means.

The base is also formed with a hole 24 in one end in which is positioned a pad 26 of rubber or other similar resilient material molded to fit the hole. The hole is larger on the end opening to the surface of the base which engages the platform than it is on its other end so that when the pad 26 is inserted from the upper side and the base is clamped to the platform, the pad is captured within the hole.

A wheel housing 30 is formed with a tubular transverse portion 32 for receiving an axle 34 carrying a pair of wheels 36. Extending upwardly from the portion 32 towards the base 16 is a leg 38 which has a rounded upper end that is captured within a socket 40 formed within the resilient pad 26 carried by the base 16.

The wheel housing is further formed with a large horizontally extending plate or flange 42 having a rectangular configuration with an enlarged rectangular recess 44 in its upper surface which faces the base 16. The lower side of the flange 42 has short vertically extending walls defining a circular recess 46. A circular hole 48 extends through the flange 42 and is approximately concentrically aligned with the post 22 and stud 23 on the base 16.

Figure 2:
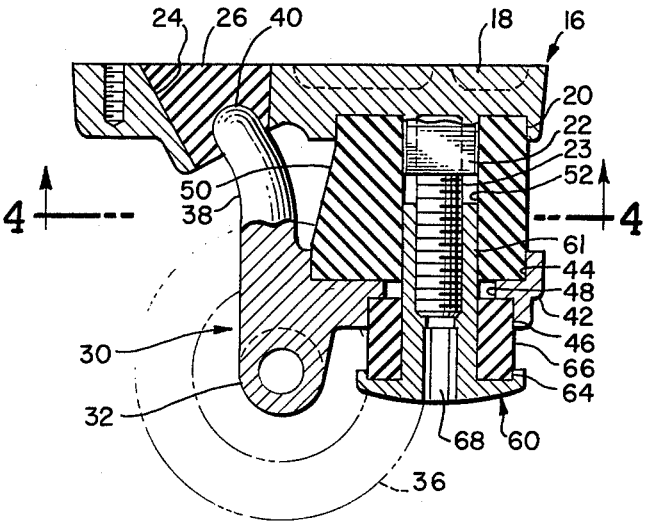
FIG. 2 is a vertical cross-sectional view of the truck of the invention.
Figure 3:
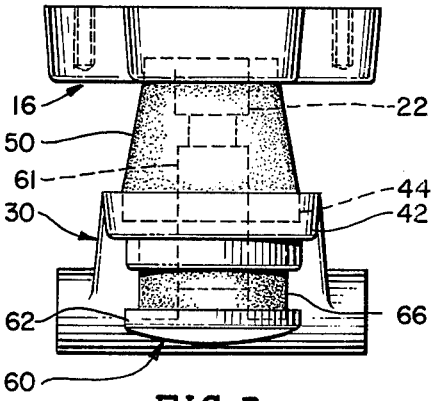
FIG. 3 is an end elevational view of the truck showing the internal components in dotted lines.
Figure 4:
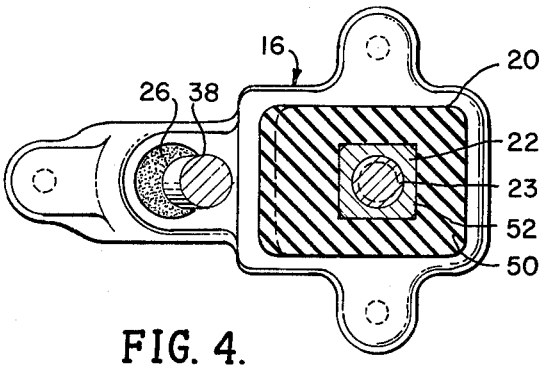
FIG. 4 is a horizontal cross-sectional view of the truck on line 4—4 of FIG. 2.
Figure 5:
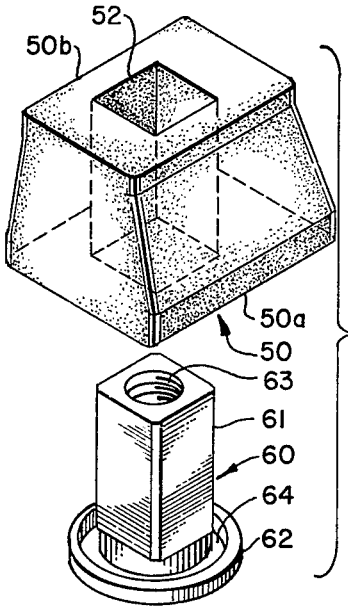
FIG. 5 is an exploded perspective view of the cushion and retainer elements in the truck.

An enlarged tubular cushion 50 made of polyurethane, rubber or other such resilient material is positioned between the base and the flange of the wheel housing. As best seen from FIG. 5, the cushion has a generally rectangular exterior cross-section which is somewhat larger on the end **50*a* engaging the flange 42 than the end 50*b* engaging the base 16. The end 50*b* engaging the base is sized to fit snuggly within the recess 20 in the base and the lower end 50*a* engaging the housing flange 42 is similarly sized to fit within the recess 44 within the flange. A central bore 52 within the cushion 50 has a square cross-section which fits snuggly over the square cross-section of the post 22** formed on the base, as seen in FIG. 2.

A fastener 60 formed with a shank 61 and an enlarged head 62 is positioned with the shank extending through the hole 48 in the flange 42 and penetrating the bore 52 within the cushion 50. The fastener shank 61 has a tubular threaded interior 63 which threads onto the stud 23 attached to the base. The shank exterior has a square cross-section approximately the size of the bore 52 within the cushion. The surface of the fastener head 62 which faces the shank has a shallow recess 64 sized to receive one end of a short cylindrical washer 66, with the other end of the washer being positioned in the lower recess 46 in the housing flange 42. The washer 66 has a central opening of square cross-section like that of the cushion 50 and the fastner 60.

In use, the parts are assembled as indicated by the drawings, and the threaded fastener 60 is threaded onto the stud 23 in the base 16, thereby compressing the cushion 50 and the washer 66. Although the cushion bore and the washer bore have square cross-sections, the resiliency of the material is such that the fastener can be manually rotated with a suitable tool. In this connection, the fastener head is provided with a central hexagonally shaped hole 68 for receiving a suitable tool for rotating the fastener. Note also from FIG. 5 that the corners of the fastener shank 61 are rounded, which facilitates rotation of the shank within the cushion 60 without damaging the cushion.

Once the desired compression on the cushion is obtained, no separate locking step is required since the fastener 60 is locked in the adjusted position due to the mating cross-sectional shapes of the cushion bore 52 and the fastner exterior. That is, although the fastener 50 can be manually rotated within the cushion, the forces experienced by the parts during operation of the skateboard are not sufficient to overcome the resistance to rotation provided by the cushion. During use of a skateboard, the primary forces are compressive forces on the cushion. While these are not uniform and are constantly changing, the forces introduced that would urge the fastner to rotate are much smaller than that necessary to overcome the resistance provided by the cushion. Thus, it can be seen that a very simple but yet reliable and effective truck is provided.

What is claimed is:

1. A truck for a skateboard or the like having a platform comprising:

a support base adapted to be mounted to the under side of the platform;

threaded means on said base;

a wheel support housing;

a resilient cushion having walls defining a bore therethrough extending between the housing and said base; and an elongated threaded retainer having a shank extending through a hole in said housing and into said cushion bore, said retainer shank having a threaded portion threaded to said base threaded means to compress said cushion and thereby resiliently mount the housing on the base, said retainer shank having an exterior portion with means thereon which mate with means on the walls of said cushion bore to prevent rotation of said retainer relative to said cushion during use of said truck, although the resiliency of said cushion permits manual forceable rotation of the retainer relative to the cushion for adjusting compression on the cushion.

2. The truck of claim 1 wherein the mating means on the exterior portion of said shank includes one or more straight sides and the walls of said cushion bore surrounding the retainer have a cross-section which mate with said retainer exterior forming said means on the walls, so that said retainer is prevented from rotation during use of the truck.

3. The truck of claim 1 wherein the mating means on the exterior portion of said shank includes straight sides, and said walls of said cushion bore surrounding the retainer have straight sides forming said means on the walls which mate with the retainer exterior.

4. The truck of claim 3 wherein the exterior of the cross-section of said retainer is square.

5. The truck of claim 1 including means on said base and on said housing for preventing rotation of said cushion.

6. The truck of claim 1 wherein said cushion has a cross-section with straight exterior sides, and said housing and said base are each formed with a recess for receiving an end of said cushion, said recesses having straight sided shapes which mate with the cushion ends and prevent rotation of the cushion.

7. The truck of claim 1 wherein said base threaded means comprises a stud fixed to and depending from said base, and said retainer is internally threaded and is threaded onto said stud.

8. The truck of claim 7 wherein said base includes a depending post and said stud is fixed to said post, the exterior of said post being sized to fit within an end of said cushion bore, and the exterior of said post and the interior of said cushion having means to prevent rotation of the cushion relative to the post.

9. The truck of claim 1 wherein said retainer includes an enlarged head; and including a washer made of resilient material which surrounds the retainer shank and is compressed between the retainer head and said housing.

10. The truck of claim 9 wherein the portion of said retainer surrounded by said washer includes a straight sided exterior and the portion of said washer surrounding the retainer mates with said straight sided exterior to prevent rotation of the washer relative to the retainer.

11. The truck of claim 1 including a leg formed on said housing and having its end received within a socket in said base to provide further means to support the housing on the skateboard.

12. A truck for a skateboard or the like having a platform comprising:

a support base adapted to be mounted to the under side of the platform;

a wheel support housing;

a resilient cushion having walls defining a bore therethrough, said cushion extending between the housing and said base; and an elongated threaded retainer having a head and having a shank extending through a hole in said housing and into said cushion bore, said retainer being threaded to said base so that the retainer head transmits force to compress said cushion and thereby resiliently mounts the housing on the base, said cushion bore and said retainer having non-circular mating wall means formed to prevent rotation of said retainer relative to said base during use of said truck, although the resiliency of said cushion permits manual forceable rotation of the retainer relative to the base for adjusting compression on the cushion.

13. A skateboard comprising:

a platform;

a truck mounted on each end of said platform including a base mounted to the underside of said platform, said base having a recess formed on its surface facing away from the platform including a top wall and a plurality of straight side walls;

a wheel support housing having an enlarged flange with a recess formed thereon having a bottom wall extending generally parallel to said base recess bottom wall and having a plurality of straight side walls;

a pair of wheels mounted on said housing;

a resilient cushion having one end shaped to fit snuggly within said base recess and another end shaped to fit snuggly within said housing recess; and threaded fastner fastner means compressing said cushion between said housing and said base and including means cooperating with said cushion which permits said fastener means to adjust the compression on said cushion but prevents loosening of said fastener means during operation of said skateboard.

14. A truck for a skateboard or the like having a platform comprising:

a base adapted to be mounted to the underside of the platform;

a threaded stud secured to said base and extending downwardly away from the base;

a wheel housing including means for supporting a pair of wheels, a support leg supported by said base, and an enlarged support flange adjacent the wheel support means extending generally parallel to said base means defining a hole in said flange aligned with said stud;

a tubular cushion of resilient material surrounding said stud and having one end of the cushion engaging said base and the other end of the cushion engaging the side of the flange facing the base;

means on said base and said housing for preventing rotation of said cushion;

a retainer having an elongated internally threaded shank and an enlarged head, the shank extending through said flange hole and into one end of said cushion and threaded onto said stud; and a washer made of resilient material mounted on said retainer between the retainer head and the other side of said flange, said retainer being threadably adjustable on said stud to compress the cushion and the washer and thereby resiliently mount the wheel housing on the base;

the exterior of said retainer and the interior of said cushion having mating straight sided walls which prevent the retainer from rotating relative to the cushion unless the retainer is forceably manually rotated for adjustment purposes.

15. The truck of claim 14 wherein said retainer exterior is substantially square and the central bore within the tubular cushion has a substantially square cross-section which snuggly receives the retainer, said base includes an integrally formed post which extends into the upper end of the cushion, said post having a square exterior which mates with the interior of the bore and the cushion, and said stud being secured in said post, said base further having a straight sided recess surrounding said post, the end of said cushion which surrounds the post has an exterior shape to fit within said recess so that rotation of the cushion is prevented, said flange having a recess on its surface facing the base which has a straight sided cross-section and the end of the cushion which engages said flange has an exterior cross-section shaped to fit within said flange recess so as to prevent rotation of the cushion, said washer has a straight sided hole adapted to mate with the straight sided exterior of the retainer, said flange has a recess on its surface facing away from the base which is adapted to receive one end of the washer and said retainer head has a recess adapted to receive the other end of said washer.

* * * * *